United States Patent [19]

Strycek

[11] 3,964,841

[45] June 22, 1976

[54] IMPELLER BLADES

[75] Inventor: Oldrich Strycek, Bratislava, Czechoslovakia

[73] Assignee: Sigma Lutin, Narodni Podnik, Lutin, Czechoslovakia

[22] Filed: Sept. 18, 1974

[21] Appl. No.: 507,211

[52] U.S. Cl. ..... 416/186 R; 416/223 A

[51] Int. Cl.[2] ..... F01D 5/04

[58] Field of Search ..... 416/223, 186, 179, 181, 416/183, 184; 415/213 R

[56] References Cited

UNITED STATES PATENTS

| | | | |
|---|---|---|---|
| 867,069 | 9/1907 | Neumann | 416/186 |
| 2,165,808 | 7/1939 | Murphy | 416/186 |
| 2,266,180 | 12/1941 | Emerick | 416/186 |
| 3,440,969 | 4/1969 | Kondo | 29/156.8 R |
| 3,610,775 | 10/1971 | Swearingen | 416/186 |
| 3,639,080 | 2/1972 | Yamabe | 416/186 |
| 3,788,765 | 1/1974 | Rusak | 416/186 X |

FOREIGN PATENTS OR APPLICATIONS

| | | | |
|---|---|---|---|
| 889,262 | 9/1953 | Germany | 415/213 R |
| 741,797 | 12/1955 | United Kingdom | 416/186 |

*Primary Examiner*—Everette A. Powell, Jr
*Attorney, Agent, or Firm*—Murray Schaffer

[57] ABSTRACT

A multi-blade impeller for a hydrodynamic pump, fan or the like. Each blade has a curved pressure and a curved suction surface. The pressure surface has a curvature, the angle of inclination of which gradually increases from the leading edge to a first point and then decreases to the trailing edge. The suction surface has a curvature, the angle of inclination of which gradually decreases from the leading edge to a second point and thereafter increases toward the trailing edge. The first point is determined by the intersection of a logarithmic spiral from the trailing edge of the adjoining blade with the pressure surface, while the second point is determined by the intersection of a second logarithmic spiral from the leading edge of the other adjoining blade with the suction surface.

2 Claims, 3 Drawing Figures

IMPELLER BLADES

RELATED APPLICATION

The present application is related to an application of which the present applicant is a co-inventer, Ser. No. 507,294, filed on Sept. 18, 1974 based upon Czechoslovak application No. PV2308/74 dated Apr. 1, 1974. Reference may be made to this co-pending application as if more fully set forth herein.

BACKGROUND OF THE INVENTION

The present invention relates to impellers for compressors, turbines, pumps, fans and the like and in particular to the construction and shape of the blades therefor.

As is well known, the blades of hydrodynamic impellers for fluid or liquid apparata are provided with curved faces to generate a centrifugal force on the fluid. In general, it is known to shape such impeller blades so that their faces are described by angles inscribed between a tangent to a point on the surface of the blade and a tangent to a circle, having its center in the axis of rotation, passing through the point, which angles gradually change in one direction only, throughout the extent of the blade. That is, the angle either increases or remains the same from the leading to the trailing tips of the blade. The blades designed by these known methods appear, when developed into a plane, to be slightly cambered or extend straight, and on the impeller itself take a logarithmic spiral shape. This design is generally thought to be the optimum possible and the resultant hydraulic characteristics of the blades so designed are thought to be incapable of any further significant improvement. However, the angular momentum of the fluid being worked on increases constantly from the inlet to the outlet of the impeller and the fluid progresses from a minimum velocity to a maximum velocity. This angular momentum is expressed by the formula $M = \rho Q (r . Cu)$, where M is the angular momentum, where $\rho$ is the specific mass of the fluid being pumped, Q is the quantity of fluid delivered in a given unit time, $r$ is the radius of the impeller, and Cu the component of absolute velocity. Since the absolute velocity is an ever changing factor, maximum efficiency, complete absence of cavitation, vibration and noise have not been obtained even with the so-called optimum design.

It is the object of the present invention to provide an improved impeller construction for hydrodynamic pumping having an improved blade configuration which overcomes the defects and disadvantages of the prior art constructions.

It is a further object of the present invention to provide an improved impeller having greater efficiency, reduction of cavitation, reduction of noise and reduction of pulsation.

It is yet another object of the present invention to provide an improved impeller having blade construction which is simple, easily fabricated, and does not affect the otherwise known construction of the impeller or pump.

The foregoing objects, other objects together with numerous advantages will be apparent from the following disclosure of the present invention.

SUMMARY OF THE INVENTION

According to the present invention the foregoing objects and advantage, are obtained by providing a multiblade rotary impeller with blades having a curved pressure surface and a curved suction surface tapering at each end to meet in trailing and leading edges wherein the angles of inclination forming the curvature of the pressure surface increase gradually from the leading edge to a first point from which they thence decrease toward the tailing edge and wherein the angles of inclination forming the curvature of the suction surface gradually decrease to a minimum value from the leading edge to a second point from which they then increase toward the trailing edge. The first point is defined as the point at which a first logarithmic spiral of the blade, running from the trailing edge of the adjoining blade on the pressure side and crossing the blade channel intersects the pressure surface. The second point is defined as the point at which a second logarithmic spiral of the blade, running from the leading edge of the adjoining blade on the suction side and crossing the blade channel, intersects the suction surface.

The values of the angles of inclination in the sections between the first and second points and the trailing and leading edges respectively are dependent upon the required level of reaction of the blade against the fluid being pumped and may be easily calculated by known analytical methods. However, in the preferred form of the present invention these angles fall within predefined ranges. Full details of the present invention, and its preferred form are given in the following disclosure and are shown in the accompanying drawing.

DESCRIPTION OF THE INVENTION

Figure 1:
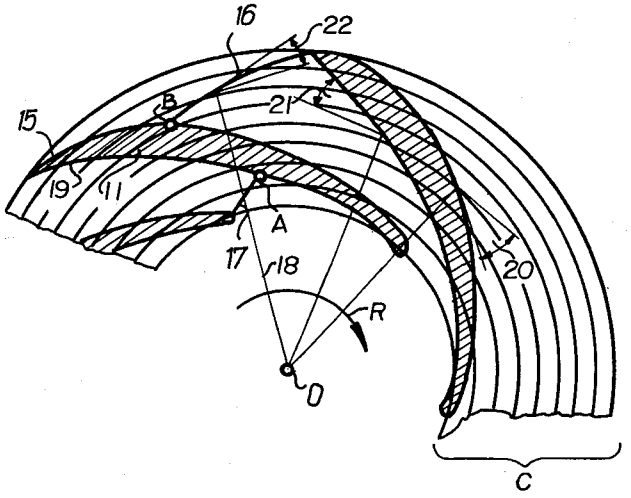
FIG. 1 is a transverse section through an impeller showing the blades constructed in accordance with the present invention.
Figure 3:
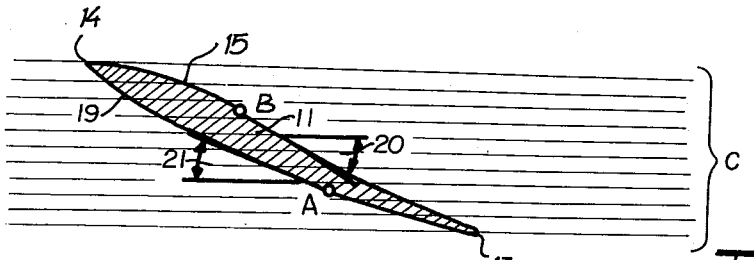
FIG. 3 is a planar development showing the curvature of the blade incorporating the present invention.
Figure 2:
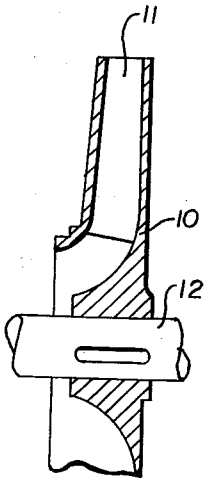
FIG. 2 is an axial section through the impeller of FIG. 1.

As seen in the drawing the impeller, generally depicted by the numeral 10, comprises a plurality of blades 11 keyed to or mounted on a shaft 12 adapted to be rotated about a central axis 0 in conventional manner. As seen in FIG. 1 each blade comprises a leading edge 13, a trailing edge 14, a pressure surface 15 and a suction surface 19. In FIGS. 1 and 3 the blades are shown drawn against a plurality of concentric circles C having a center 0 coincident with the axis of rotation R. In FIG. 3 the flow of fluid is indicated by the arrow F.

According to the present invention each of the blades have pressure and suction surfaces in which the curvature continuously varies in angular inclination from leading to trailing edge. The angles of inclination 20 forming the curvature of the pressure surface increase gradually starting from its leading edge up to a point B from which they again decrease up to its minimum value at the trailing edge. However, the angles of inclination 21 forming the curvature of the suction surface decrease gradually from the leading edge to a point A from which they thence increase toward the trailing edge.

The point B, according to the present invention, is obtained by calculating the intersection point with the pressure surface 15, made by a logarithmic spiral 16, running from the trailing edge 14 of the adjoining blade on the pressure side and passing across the blade channel. The point A is likewise obtained as the intersection point with the suction surface 19 of a second logarithmic spiral 17 running from the leading edge 13 of the adjoining blade on the suction side and running across the blade channel.

The shape of the logarithmic spirals 16 and 17 and the position of the points A and B are conventionally determined by well known analytical methods. Similarly, the angles of inclination in any given section or the angle of inclination at any given point along the respective surfaces are also calculated by well known analytical methods and principles wherein the angle of inclination at any point on the surface of the ablde is described by the tangent to the surface at that point and a tangent to a circle, having its center in the axis of rotation, passing through that point. In all instances, the calculations will depend upon the required degree or level of reaction of the impeller with respect to the liquid or fluid pump and the given parameters of operation. Briefly, each of the angles of inclination on the surface of the blades are taken with respect to a tangent drawn to the radii 18 from the center of rotation 0, indicated in the drawings simply by the concentric circles C. The logarithmic spirals 16 and 17 are similarly drawn, conventionally, with respect to the center of rotation.

According to the present invention the values of the angles of inclination with respect to the surfaces of the blade and that of the logarithmic spirals should be maintained within certain ranges in order to obtain a most preferred and beneficial results. These ranges are as follows:

The magnitude of the angle as a curve intersecting a plurality of concentric circles, having their center in the axis of rotation, at a constant angle, defined by their tangents at point B, on the pressure surface, is between 10° to 60° greater than that of the inlet angle, or the angle at which the pressure surface makes at the leading edge, The angle of inclination 22 of the log spiral 16 with respect to the concentric circles C, is within the range of 10° to 40°.

The angle of the pressure surface of the blade at the outlet (i.e. trailing edge) is less than the angle of inclination at point B by 5° to 50°, The angle of the suction surface of the blade at the point A is smaller with respect to the inlet angle (i.e. leading edge) within the range of 1° to 20°, The angle 23 of the logarithmic spiral 17 with respect to the concentric circles C is within the range of 10° to 40°, The angle of inclination of the suction surface of the blade at the outlet (i.e. trailing edge) is greater than the angle of inclination at point A, within the range of 10° to 60°.

Impellers having blades designed according to the present invention and having angles of inclination within the preferred ranges, exhibit better hydraulic characteristics than those impellers knon from the prior art. The present impellers have significantly reduced pressure pulsations and vibrations and permit the increase in velocity of the liquid pumped. Further cavitation as well as stability of the liquid pumped is improved. In general, the overall efficiency of pumps employing the present impellers are greatly improved.

From the foregoing, it is obvious that various changes and modifications may be made to the form and structure of the impeller and blades, all within the described parameters. It is accordingly intended that the present disclosure be taken as illustrative only and not as limiting of the present invention.

What is claimed is:

1. In a blade for a multi-blade rotary impeller of a hydrodynamic pump, fan or the like, comprising a curved pressure surface and a curved suction surface tapering at each end to meet in a trailing and leading edge, the improvement wherein the angles of inclination forming the curvature of the pressure surface increase gradually to a maximum value from the leading edge to a first point from which they thence decrease toward the trailing edge, the angles of inclination forming the curvature of the suction surface gradually decrease to a minimum value from the leading edge to a second point from which they thence increase toward the trailing edge, said first point being the point at which a first logarithmic spiral of said blade, running from the trailing edge of the adjoining blade on the pressure side and crossing the blade channel, intersects said pressure surface, and said second point being the point at which a second logarithmic spiral of said blade, running from the leading edge of the adjoining blade on the suction side and crossing the blade channel, intersects said suction surface.

2. The blade according to claim 1 wherein:

The magnitude of the angles of inclination at the first point is between 10° to 60° greater than the angle of inclination of the curvature of the pressure surface at the leading edge, The angle of inclination of the first logarithmic spiral with respect to the concentric circles about the center of rotation of said impeller is within the range of 10° to 40°, The angle of inclination of the pressure surface at the trailing edge is less than the angle at the first point by 5° to 50°, The angle of inclination of the suction surface at the second point is smaller than the angle of inclination of the suction surface at the leading edge by 1° to 20°, The angle of the second logarithmic spiral with respect to the concentric circles about the center of rotation of said impeller, is within the range of 10° to 40°, and The angle of inclination of the suction surface at the trailing edge is greater than the angle of inclination at the second point by 10° to 60°.

* * * * *